US005610795A

United States Patent [19]

Snelling

[11] Patent Number: 5,610,795

[45] Date of Patent: Mar. 11, 1997

[54] SELF BIASING CHARGING MEMBER

[75] Inventor: Christopher Snelling, Penfield, N.Y.

[73] Assignee: Xerox Corporation, Stamford, Conn.

[21] Appl. No.: 283,337

[22] Filed: Aug. 1, 1994

[51] Int. Cl.[6] ..... G03G 15/02

[52] U.S. Cl. ..... 361/225; 310/339; 399/162

[58] Field of Search ..... 361/214, 221, 361/222, 225, 230; 355/219; 310/311, 330–332, 339, 367, 369, 800

[56] References Cited

U.S. PATENT DOCUMENTS

| | | | |
|---|---|---|---|
| 3,500,451 | 3/1970 | Yando | 310/330 |
| 3,876,917 | 4/1975 | Gaynor et al. | 361/225 |
| 4,106,933 | 8/1978 | Taylor | 310/311 X |
| 4,380,384 | 4/1983 | Ueno et al. | 355/219 |
| 5,005,051 | 4/1991 | Haruki et al. | 355/219 X |

FOREIGN PATENT DOCUMENTS

| | | | |
|---|---|---|---|
| 699-590 | 11/1979 | U.S.S.R. | 310/339 |

*Primary Examiner*—Fritz Fleming
*Attorney, Agent, or Firm*—Lloyd F. Bean, II

[57] ABSTRACT

An apparatus and method for depositing a surface charge on a dielectric medium moving at a predetermine velocity in a direction of movement, including an endless web having an exterior layer comprising piezoelectric material, position adjacent to the dielectric medium, for generating and laying down the surface charge on the dielectric medium in response to the endless web being deformed.

13 Claims, 9 Drawing Sheets

FIG. 2A
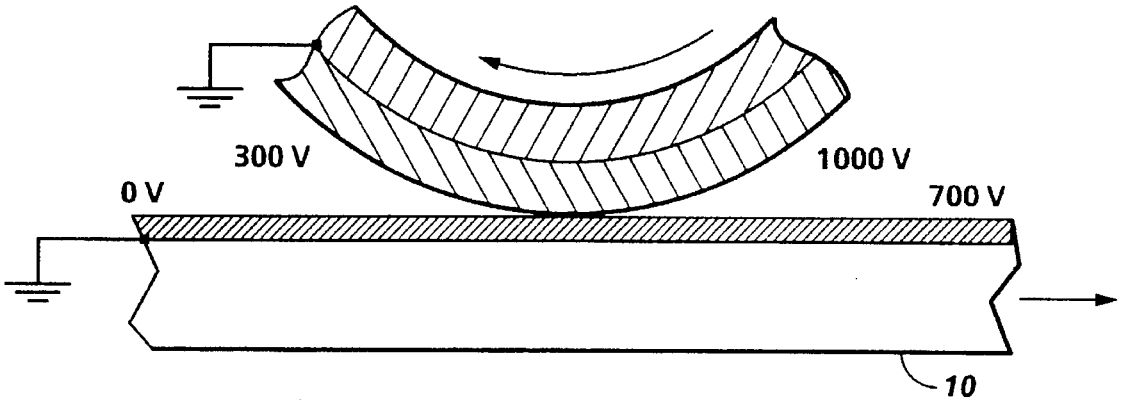
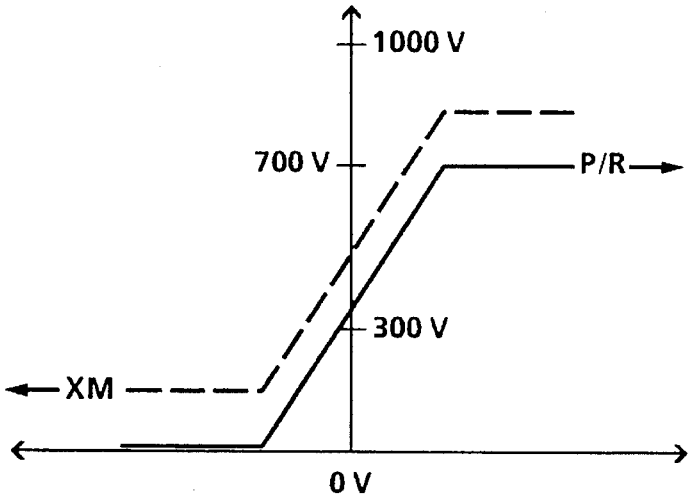
FIG. 2B

FIG. 4
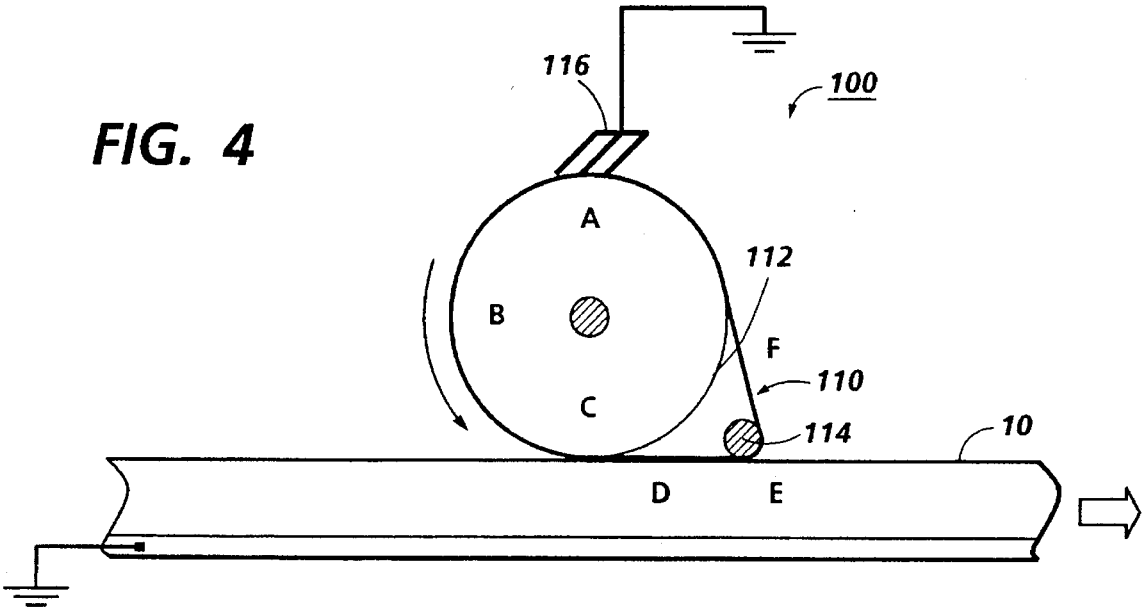
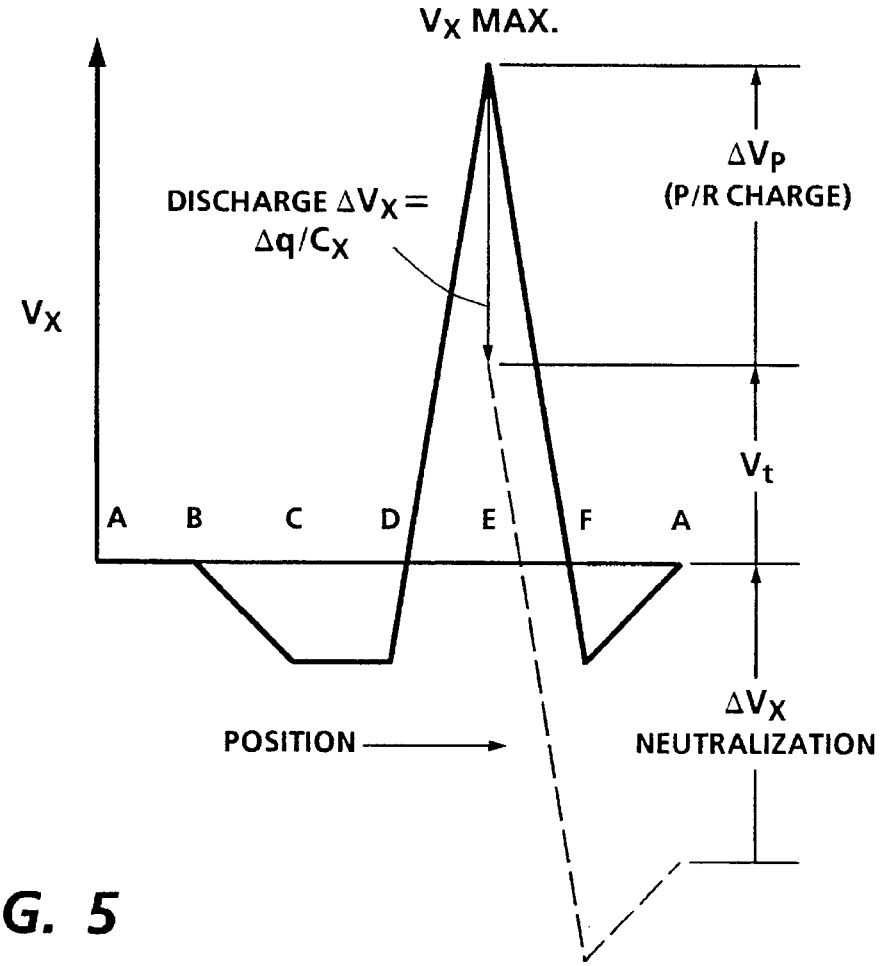
FIG. 5

SELF BIASING CHARGING MEMBER

The present invention relates generally to apparatus for charging a dielectric material, primarily for use in reproduction systems of the xerographic, or dry copying, more particularly, concerns a charging member having piezoelectric material for generating and laying down a surface charge on a dielectric medium having a conductive backing, such as a photoconductive belt, web or drum.

Generally, the process of electrostatographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate to create an image which may be permanently affixed to the image support substrate, thereby providing an electrophotographic reproduction of the original document. In a final step in the process, the photoconductive surface of the photoreceptive member is cleaned to remove any residual developing material which may be remaining on the surface thereof in preparation for successive imaging cycles.

The electrostatographic copying process described hereinabove is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

As discussed above, in electrostatographic reproductive devices it is necessary to charge a suitable photoconductive or reproductive surface with a charging potential prior to the formation thereon of the light image. Various means have been proposed for the application of the electrostatic charge or charge potential to the photoconductive insulating body of Carlson's invention; one method of operation employs, for charging the photoconductive insulating layer, a form of corona discharge wherein an adjacent electrode comprising one or more fine conductive bodies maintained at a high electric potential causes deposition of an electric charge on the adjacent surface of the photoconductive body. Examples of such corona discharge devices are described in U.S. Pat. No. 2,836,725, to R. G. Vyverberg and U.S. Pat. No. 2,922,883, to E. C. Giamio, Jr. In practice, one corotron (corona discharge device) may be used to charge the photoconductor before exposure and another corotron used to charge the copy sheet during the toner transfer step. Corotrons are cheap, stable units, but they are sensitive to changes in humidity and the dielectric thickness of the insulator being charged. Thus, the surface charge density produced by these devices may not always be constant or uniform.

As an alternative to the corotron charging systems, roller charging systems have been developed. Such systems are exemplified by U.S. Pat. No. 2,912,586, to R. W. Gundlach; U.S. Pat. No. 3,043,684, to E. F. Mayer; U.S. Pat. No. 3,398,336, to R. W. Martel et al. (two phase liquid film interposed between and in contact with dielectric layer and charging roller); U.S. Pat. No. 3,684,364, to F. W. Schmidlin; and U.S. Pat. No. 3,702,482,i to Dolcimascolo et al. In the above prior art devices are concerned with contact charging, that is the charging roller is placed in contact with the surface to be charged, e.g. the photoreceptor or final support (paper) sheet.

Surface contact charging rollers of the above-mentioned prior art type are restricted to a speed of rotation which is controlled by the speed of movement of the surface to be charged. In other words, because the charging roller contacts the support member, whether it be the photoconductor drum or belt or a paper sheet to which toner is to be transferred, the surface velocity of the charging roller must be equal to the velocity of the chargeable support member. U.S. Pat. No. 3,935,517 to O'Brien discloses the general relationship between energy stream intensity and imaging surface velocity required to achieve uniform charging of the imaging surface. In that Patent, the charging roller is spaced from imaging surface and does not have to be synchronized with the movement of the imaging surface.

Moreover, in all of these prior art devices the roller materials must, in general, be tailored to the particular application and the amount of charge placed on the chargeable support is usually only controlled as a function of the voltage applied to the charging roller. The prevention of pre-nip breakdown is achieved by appropriate selection of roll electrical properties. Dielectric relaxation times of charging and transfer rollers structures are defined according to the specific process speed. In addition to requiring changes in charging rollers structures for different operating speeds, the relaxation times of charging rollers must be maintained within an acceptable range. Degradation due to changes in conductivity by roll contamination of roll material changes represents, therefore, a potential failure mode of charging rollers.

Further, all of these prior art devices require sources of high voltage at low current levels for powering the bias rolls. This requirement has been usually met by incorporating high voltage power supplies. These high voltage power supplies have added to the overall cost and weight of electrophotographic printers.

A simple, relatively inexpensive, and accurate approach to eliminated the expense and weight of traditional high voltage sources in such printing systems has been a goal in the design, manufacture and use of electrophotographic printers. The need to provide accurate and inexpensive transfer and charging systems has become more acute, as the demand for high quality, relatively inexpensive electrophotographic printers has increased.

Various techniques for charging without incorporating high voltage power supplies have hereinbefore been devised. U.S. Pat. No. 4,106,933 to Taylor teaches a method for printing using photoconductor with piezoelectric material having dipoles that are permanently poled to form a permanent pattern corresponding to a graphic representation. Subsequently, the permanently poled material can be used by straining the material to produce a charge pattern representative of the graphic representation, which can then be developed with toner powder, transferred to a sheet of paper, and fused to form a printed page. The straining, toning and fusing process may be repeated, thereby producing multiple copies. In a similar embodiment, U.S. Pat. Nos. 3,935,327 and 3,899,969 to Taylor discloses a method for copying a graphic representation using a uniformly poled pyroelectric material in a photoconductor. The material is selectively heated to form a differential charge pattern on the material that can be developed with charged toner particles to form a copy of the graphic representation.

However, even with the before mentioned disclosures the need for a discrete charging device which can be utilized on various photoreceptor without use of an external voltage supply still remains.

SUMMARY OF THE INVENTION

Pursuant to one aspect of the invention there is provided an apparatus for depositing a surface charge on a dielectric medium moving at a predetermine velocity in a direction of movement, including an endless web having an exterior layer comprising piezoelectric material, position adjacent to the dielectric medium, for generating and laying down the surface charge on the dielectric medium in response to the endless web being deformed.

Pursuant to another aspect of the invention there is provided a method for depositing a surface charge on a dielectric medium moving at a predetermine velocity in a direction of movement, including the step of providing an endless web having an exterior layer comprising piezoelectric material. The step of positioning the end web adjacent to the dielectric medium. The step of generating an electric field from the endless web. And, the step of inducing the surface charge on the dielectric medium from the electric field from the endless web.

BRIEF DESCRIPTION OF THE DRAWINGS

These and other aspects of the present invention will become apparent from the following description in conjunction with the accompanying drawings in which:

FIG. 2A illustrates the geometrical arrangement asynchronous charging;

FIG. 2B illustrates the surface potentials of the photoreceptor and the surface of the charging member;

FIG. 4 illustrates another embodiment of the present invention;

FIG. 5 illustrates the electric potential of the photoreceptor employing the charging device of FIG. 4;

Figure 1:
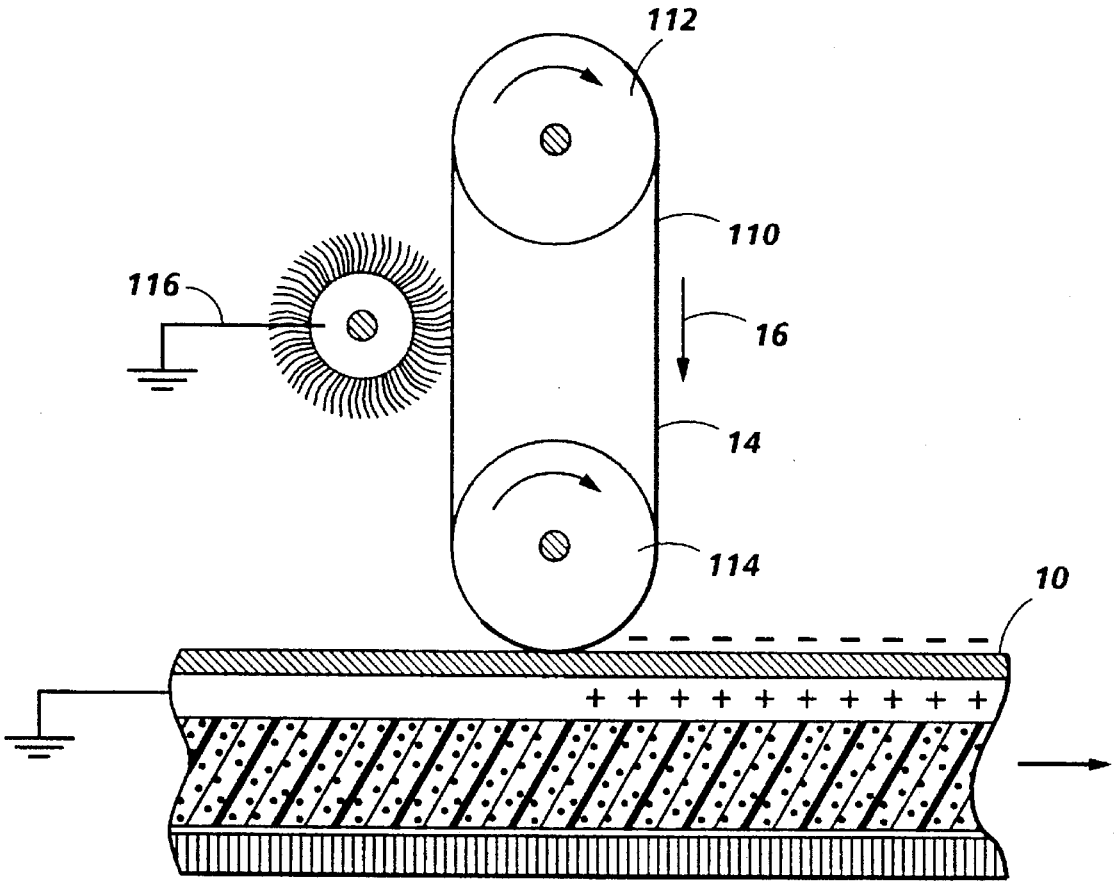
FIG. 1 illustrates the charging member of the present invention.

As indicated hereinabove, the present invention provides a novel charging member for use in an electrostatographic printing machine. While the present invention will be described with reference a preferred embodiment thereof, it will be understood that the invention is not limited to this preferred embodiment. On the contrary, it is intended that the present invention cover all alternatives, modifications, and equivalents as may be included within the spirit and scope of the invention as defined by the appended claims. Other aspects and features of the present invention will become apparent as the description proceeds.

Referring now to the drawings, where the showings are for the purpose of describing a preferred embodiment of the invention and not for limiting same, the various processing stations employed in the reproduction machine illustrated in FIG. 13 will be described only briefly. It will no doubt be appreciated that the various processing elements also find advantageous use in electrophotographic printing applications from an electronically stored original.

A reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 18 and tension roller 16 are rotatably mounted. These rollers are idlers which rotate freely as belt 10 moves in the direction of arrow 12.

Figure 13:
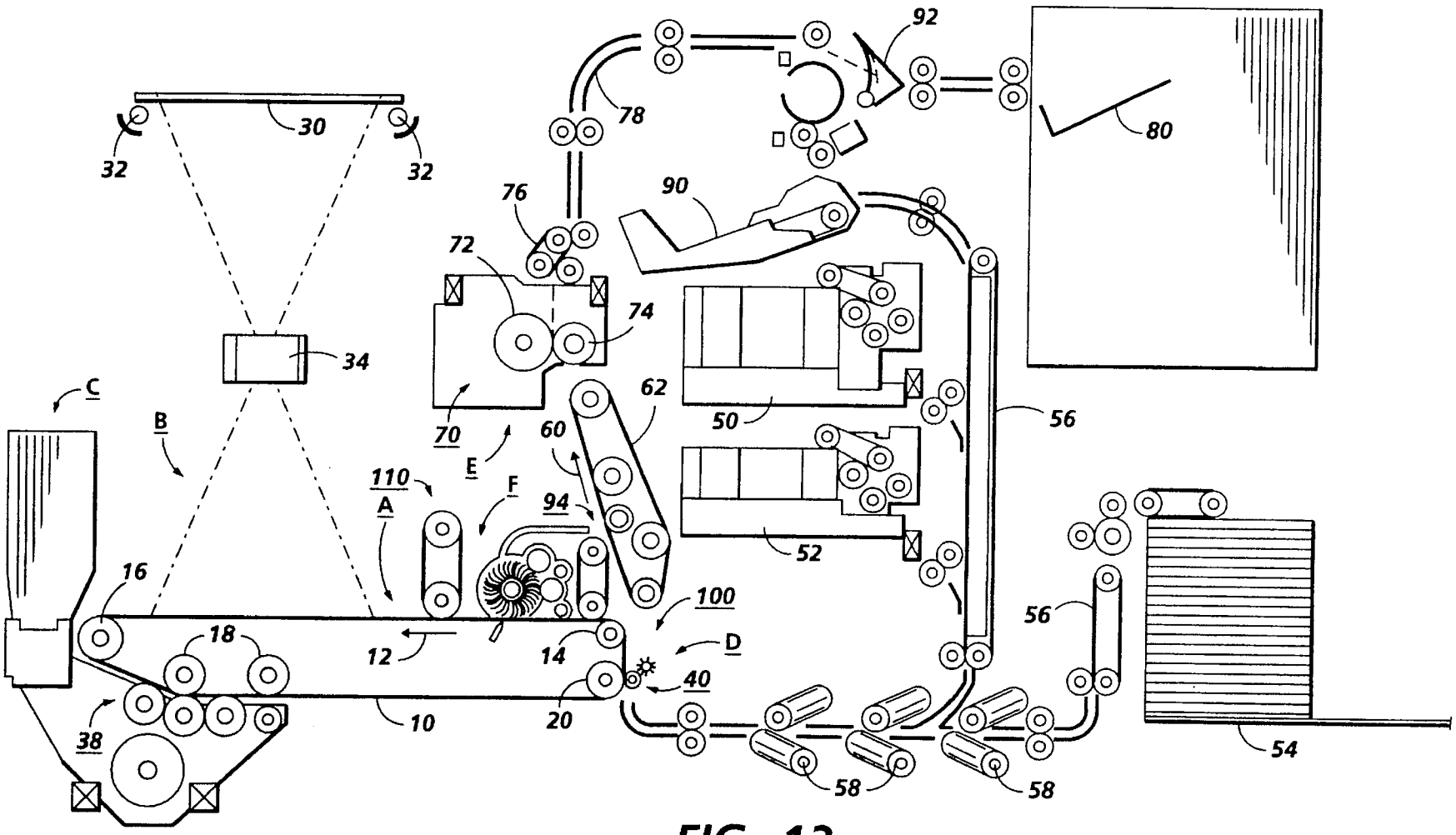
FIG. 13 illustrates the charging member of the present invention a typical electrostatographic printing machine.

With continued reference to FIG. 13, initially a portion of belt 10 passes through charging station A. At charging station A, charging member 110 of the present invention, which will be discussed in greater detail infra charges photoreceptor belt 10 to a relatively high, substantially uniform potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, belt 10 advances the electrostatic latent image to development station C. At development station C, a developer unit 38 advances one or more colors or types of developer mix (i.e. toner and carrier granules) into contact with the electrostatic latent image. The latent image attracts the toner particles from the carrier granules thereby forming toner images on photoreceptor belt 10. As used herein, toner refers to finely divided dry ink, and toner suspensions in liquid.

Belt 10 then advances the developed latent image to transfer station D. At transfer station D, a sheet of support material such as a paper copy sheet is moved into contact with the developed latent images on belt 10. First, the latent image on belt 10 is exposed to a pre-transfer light from a lamp (not shown) to reduce the attraction between photoreceptor belt 10 and the toner image thereon. Next, charging device 40, also of the present invention, charges the copy sheet to the proper potential so that it is tacked to photoreceptor belt 10 and the toner image is attracted from photoreceptor belt 10 to the sheet. Preferably, charging device 40 is of the type describe in Co-pending application Ser. No. 08/282,588, filed concurrently herewith on Jul. 27, 1994, entitled "SELF BIASING TRANSFER ROLL", which is hereby incorporated by reference. After transfer, the sheet is stripped from belt 10 at stripping roller 14. The support material may also be an intermediate surface or member, which carries the toner image to a subsequent transfer station for transfer to a final substrate. These types of surfaces are also charge retentive in nature.

Sheets of support material are advanced to transfer station D from supply trays 50, 52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner images to the sheets. Preferably, fuser assembly 70 includes a heated fuser roller 72 adapted to be pressure engaged with a back-up roller 74 with the toner images contacting fuser roller 72. In this manner, the toner image is permanently affixed to the sheet.

After fusing, copy sheets bearing fused images are directed through decurler 76. Chute 78 guides the advancing sheet from decurler 76 to catch tray 80 or a finishing station for binding, stapling, collating etc. and removal from the machine by the operator. Alternatively, the sheet may be advanced to a duplex tray 90 from duplex gate 92 from which it will be returned to the processor and conveyor 56 for receiving second side copy.

A pre-clean device 94 is provided for exposing residual toner and contaminants (hereinafter, collectively referred to as toner) to an opposite charge of the toner to thereby narrow the charge distribution thereon for more effective removal at cleaning station F. It is contemplated that residual toner remaining on photoreceptor belt 10 after transfer will be reclaimed and returned to the developer station C by any of several well known reclaim arrangements, and in accordance with arrangement described below, although selection of a non-reclaim option is possible.

As thus described, a reproduction machine in accordance with the present invention may be any of several well known devices. Variations may be expected in specific processing, paper handling and control arrangements without affecting the present invention.

Referring now specifically to FIG. 1, it will be seen from FIG. 1 that belt 110 is entrained about tension roller 114 and drive roller 112. Drive roller 112 is coupled to a motor (not shown) by suitable means such as a belt drive. Belt 110 is maintained in tension by a pair of springs (not shown) resiliently urging tension roller 114 against belt 110 with the desired spring force. Roller 114 is rotatably mounted and rotates freely as belt 10 moves in the direction of arrow 16. Belt 110 comprises a peripheral surface layer 14 of a piezoelectric polymer film, such as polyvinylidene fluoride (PVDF) film, preferably Kynar® film manufactured by Pennwalt KTM.

Figure 6:
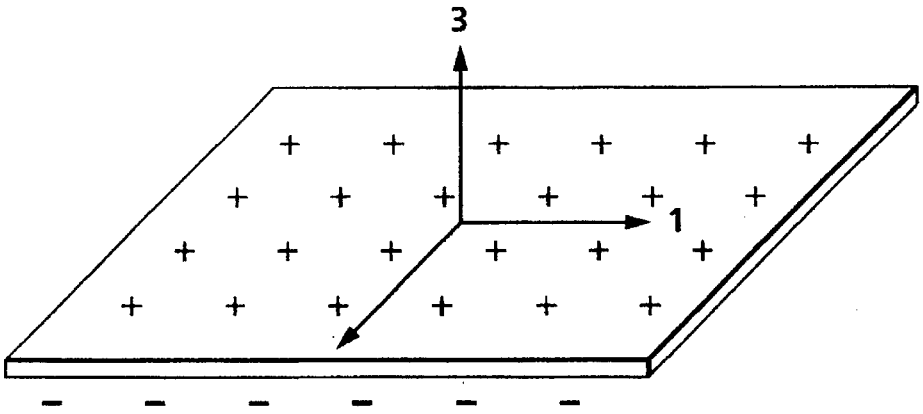
FIG. 6 illustrates the geometry of a piezoelectric sheet.

PVDF materials are formed by stretching the film in one direction, and applying a large electric field to electrically polarize it in a direction perpendicular to the film. In FIG. 6, the stretch direction is denoted by "1" and the polarization direction is denoted by "3". When a PVDF sheet is strained, it develops an internal electric field which is proportional to the deformation.

Figure 7:
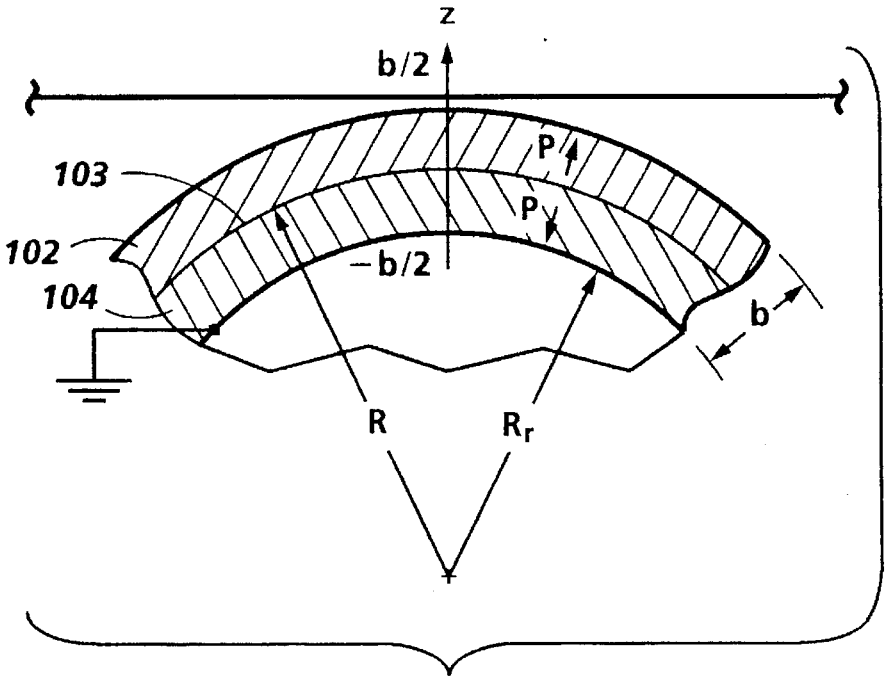
FIG. 7 illustrates a bimorph Xeromorph which is utilized by the present invention.
Figure 8:
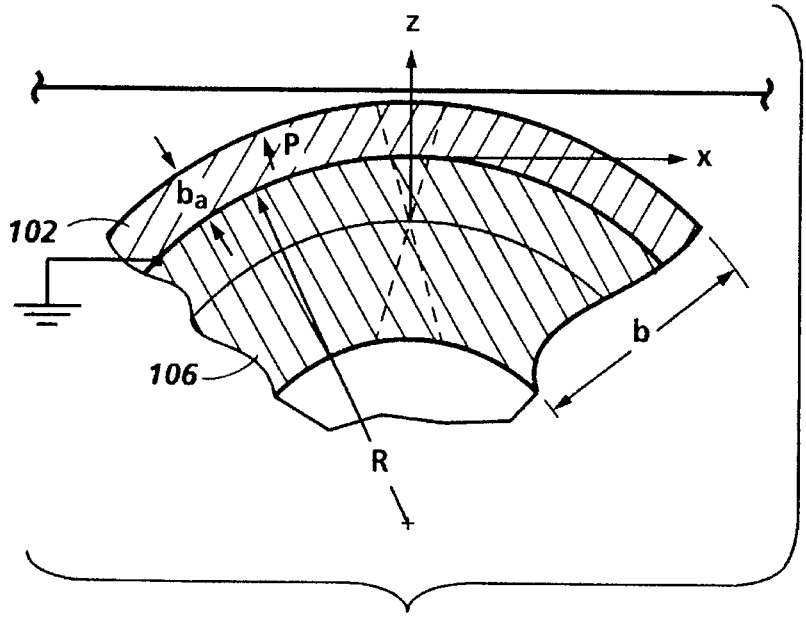
FIG. 8 illustrates a unimorph Xeromorph which is utilized by the present invention.

The present invention utilizes either a bimorph or a unimorph structure referred to as a "Xeromorph". A bimorph Xeromorph consists of two PVDF sheets 102 and 104 laminated together with sheet polarization direction opposed to each other and having only a bottom electrode, as shown in FIG. 7. A unimorph Xeromorph consists of a single PVDF sheet 102 laminated to a thick substrate 106 as shown in FIG. 8. The substrate material may comprise materials which can be bent, and have no piezoelectric properties.

Belt 110 is sufficiently elastic and resilient to deform around roller 114. As belt 110 deforms around the radius of roller 114 an electric potential is generated on the surface of belt 110 due to strain imparted to its piezoelectric constituants. An electric field is thereby created in the nip region formed between belt 10 and belt 110. Belt 110 lays down a surface charge on belt 10 when air ionization, for example, occurs in the gap. It will be appreciated that as belt 110 moves around rollers 112 and 114, neutralization and cleaning brush 116 cleans the surface of belt 110 and eliminates residue charges thereon where belt 110 is flat and there is no external electric field prior to deformation of belt 110 around rollers 112 and 114.

Also, It will be appreciated from the present description that a desired electrical potential can be achieved selecting the appropriate diameter for the radius for roller in contact with the imaging forming surface, this will be discussed in greater detail infra.

It has been found that the prevention of air gap break down or ionization in the entrance nip is important to prevent charging and transfer non-uniformities. These disturbances are commonly referred to as "tiger stripes" and occur because of oscillating self quenching of air gap discharge in the entrance zone of the nip. A method that can be used to prevent tiger stripe charging non-uniformities is to limit the difference of potential between the photoreceptor and Xeromorph surfaces at the entrance nip from approaching the level at which air breakdown can occur. Based upon the Paschen curve as disclosed in *ELECTROPHOTOGRAPHY*, R. M. Schaffert, 2nd Edition, Focal Press, 1975 pg. 514., the minimum air breakdown voltage is about 360 volts. It has been found that employing an asynchronous charging mode with the present invention reduces "tiger stripes".

FIG. 2A shows the geometrical arrangement of the mode of asynchronous charging. The photoreceptor being charged is moving to the right while the Xeromorph charging member is shown moving from right to left. FIG. 2B represents the surface potentials of the photoreceptor (P/R) and Xeromorph with solid and dotted lines respectively through the nip. The Xeromorph surface potential (X/M) is initially established at 1000 volts, for example, by appropriate bending around the radius of the roller and neutralization. If the photoreceptor charges to 700 volts, then the potential difference (100–7000)=300 volts in the exit nip this is below the 360 volt air breakdown minimum. At the entrance nip, the photoreceptor is initially at 0 volts. The surface potential of the Xeromorph will depend upon the quantity of charge that has been transferred from the Xeromorph to the photoreceptor through the nip. The example in FIG. 2A assumes that the Xeromorph surface potential has been reduced to 300 volts. In this case, then, the potential difference (300–0)=300 volts in the entrance nip is also below the 360 volt air breakdown minimum. In this example, the potential difference between the photoreceptor and Xeromorph surfaces in both the entrance and exit air gaps has been limited to less than 360 volts thereby preventing air breakdown.

It is expected that the relationship between the surface potential reduction of the Xeromorph and photoreceptor surface potential increase (charging) will initially depend upon their relative electrical capacities, i.e., $\Delta Vxm/\Delta Vp/r=(Cp/r/Cxm)$ K, where K=Speed Ratio (Sxm/Sp/r)

Relative speeds of the Xeromorph (Sxm) and the photoreceptor (Sp/r) determine the effective time integrated total capacities of each the Xeromorph and the photoreceptor through the nip. Speed ratio K is therefore a convenient parameter to use to adjust the asynchronous Xeromorph charging system for optimum performance.

Asynchronous Xeromorph charging has been tested using the experimental arrangement of the following: A Xeromorph device has comprised a 110μ thick poled PVDF Kynar® piezo film bonded to a 0.003" nickel seamless belt to form a unimorph structure. The seamless belt was mounted on a motorized two roll fixture. A conductive brush neutralized the Xeromorph surface potential in the flat zone. Bending of the Xeromorph over the roll at the charging nip produces surface potential of magnitude Vxm which may be determined by ESV measurement at the other roll which is of the same diameter. Aluminized 0.001" Mylar was used as a surrogate photoreceptor in this asynchronous Xeromorph charging experiments.

Figure 3A:
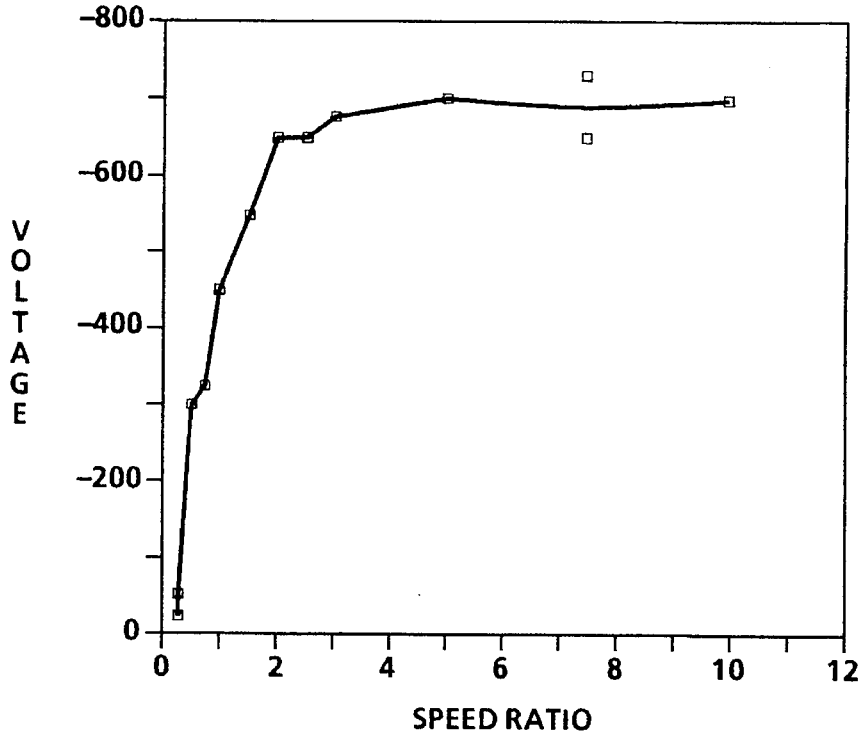
FIGS. 3A and 3B illustrate experimental data generated by the present invention employing the asynchronous, charging mode.

FIG. 3A shows experimental data generated with this device. The 0.001" Mylar was charged to a surface potential value approaching 700 volts as the speed ratio was increased. The surface potential of the mylar appeared to asymptote to the 700 volts value at a speed ratio K of order 3–4 in this experiment.

Figure 3B:
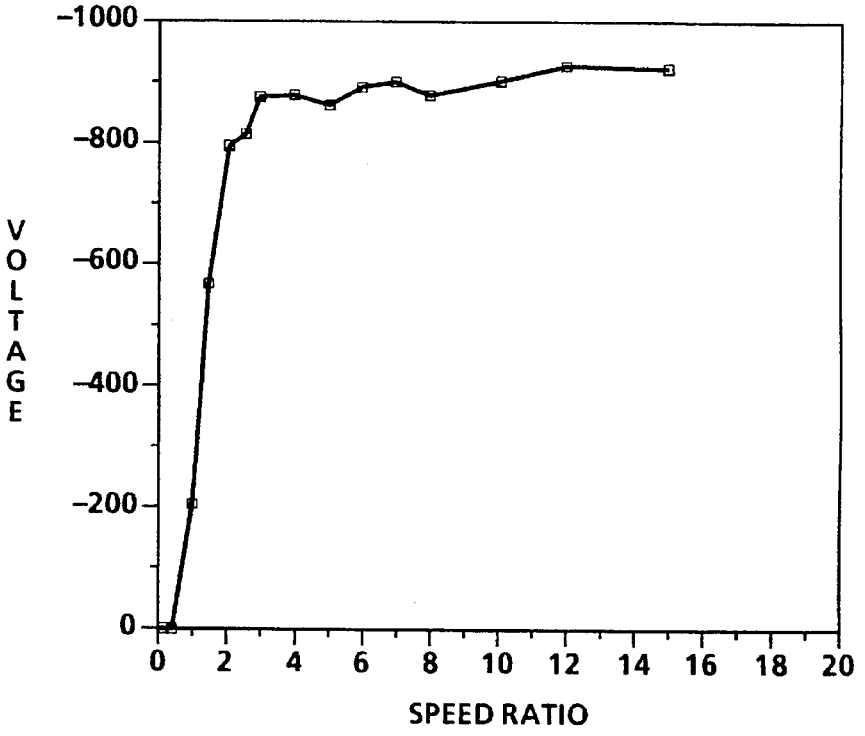

FIG. 3B shows data generated using a photoreceptor belt in place of the 0.001" Mylar. Again, the charging appears to asymptote. The surface potential of approximately −900 volts approached a at a speed ratio of order 3–4 is of appropriate magnitude for subsequent xerographic imaging.

Another embodiment of the present invention is shown in FIG. 4. This embodiment discloses another method to prevent the nonuniformities due to pre-nip breakdown. This method to controls (tailors) the electric field magnitude through the nip region in a manner that assures that air breakdown can only occur in the post nip region.

FIG. 5 shows Xeromorph surface potential $V_x$ due to the controlled bending of a Xeromorph belt shown in FIG. 4. Since surface potential of the Xeromorph is inversely related to its bend radius (this will be discussed in greater detail infra), the Xeromorph belt surface potential Vx can be predicted at locations A, B, C, D, E, and F as shown in the plot included in FIG. 5. For this example, a Xeromorph structure has been assumed that creates more positive surface potentials when it is bent to decreasing radiuses.

Referring now to FIG. 5:

at position A the neutralization and cleaning brush establishes the starting Vx=0 volts at position B R (radius of curvature) has not changed and therefore Vx=0 volts at positions C & C) the radius R is very large making Vx<<0 volts (i.e. Vx=negative polarity)

at position E the Xeromorph belt is bent into a small radius making Vx (α1/R) a large positive value. If Vx is greater than the breakdown voltage for the small, but increasing, post-nip gap air breakdown will reduce Vx to Vt (the discharge sustaining voltage for that gap) by effectively transferring charge Δq from the Xeromorph surface to the photoreceptor surface. As shown in FIG. 5, the voltage magnitudes of Xeromorph discharge and photoreceptor charging are equal. This will occur only when their electrical capacities are the same. Otherwise, $Vp/r=(Cx/Cp)\Delta Vx$ where Cx=Xeromorph capacity, Cp=photoreceptor capacity.

at position F the radius is again large (like C and D). If Vx has not exceeded the breakdown voltage, than Vx=V at C and D. If breakdown has occurred, than Vx will be more negative by the same magnitude ΔVx that the xeromorph surface potential was reduced as the result of the air breakdown discharge Δq.

at position A (again) the neutralization brush will reestablish Vx=0 Volts. In the case where air breakdown charging of the P/R has occurred, current flow from ground will replace the charge Δq that was transferred to the photoreceptor surface.

Figure 9:
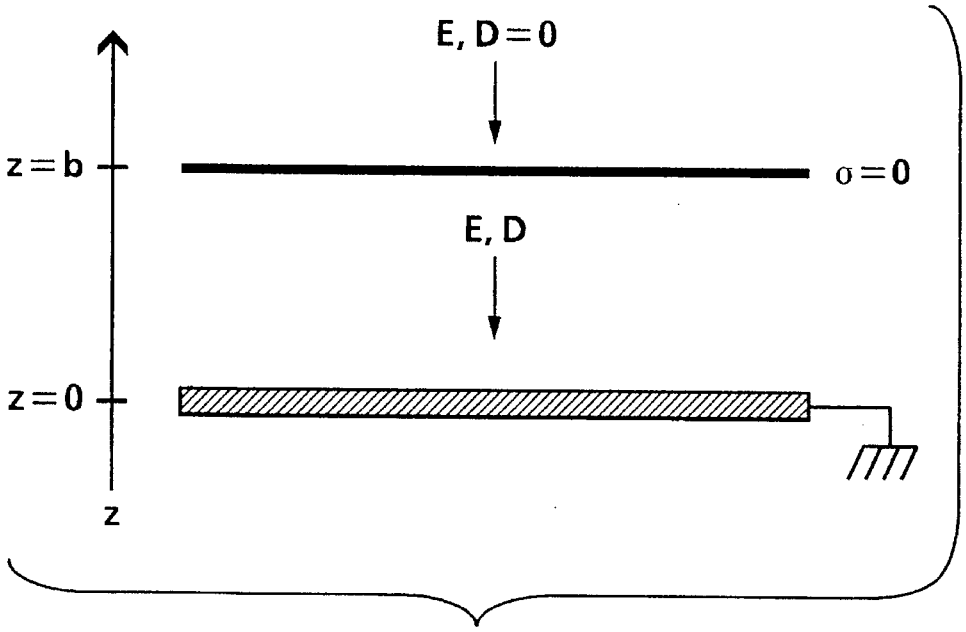
FIG. 9 illustrates the air gap above in a piezoelectric voltage generator.

Having in mind the construction and the arrangement of the principal elements thereof, it is believe that a complete understanding of the present invention may be now had from a description of its operation. Although not wanting to be limited by theory, principal elements of the present invention is believed to operate in accordance to the following model:

It has been found that the the highest voltages and fields are produced when the bottom of the active piezoelectric layer is grounded, as shown in FIG. 9.

Above the layer, the upper ground plane is very far away, so that the electric field above the surface is negligible. This is the situation obtained when measuring the surface potential with an electrostatic voltmeter, which is feedback controlled to neutralize the external electric field. The model assumes that the surface of the film is uncharged, as is the bulk.

The only remaining source of electrostatic fields is the polarization which appears in the material when it is bent, as given by $$D=\epsilon E+P$$

Since the space charge inside the film is zero, $$\nabla\cdot D=p=0$$

so that $$D=\text{const}$$

inside the film. There is no charge at the surface of the film, so the D vector will be continuous across the interface, $$D_a=D_b$$

and since the E field (and hence the D field)is zero in the air gap, $$D_b=\epsilon E_b(z)+P(z)=0$$

The E field in the layer is given by $$E_b(z)=-\frac{P(z)}{\epsilon}$$

The E field inside the layer will not be uniform, since it changes with P, which in turn depends on the local strain. The surface potential at the top of the layer can be obtained by integrating the E field from the ground at z=0 up to the surface at z=b, to give the open circuit voltage of the piezoelectric layer as $$V_o = -\int_0^b E_b(z)dz = \int_0^d \frac{P(z)}{\epsilon}\, dz$$

or, in terms of the piezoelectric coefficient, h, and the strain, $$V_o = -h\int_0^b S(z)dz$$

Thus, the strain distribution needs to be determined before the open circuit voltage can be calculated.

When the sheet is bent, the outer surface of the sheet becomes longer, and the inner surface becomes shorter.

Somewhere inside the sheet is the neutral level, where there is no change in the length. For a uniform material, like a single sheet of Kynar®, the neutral position will be in the middle, as shown in the FIG. 7. The strain is defined by $$\text{strain} = \frac{\text{actual length} - \text{unstretched length}}{\text{unstretched length}}$$

Along the neutral axis 103, there is no change in length, so for a given arc of angle θ

$$\text{unstretched length} = R\theta$$

where R is the radius of curvature of the neutral axis. Away from the neutral axis 103, the length is given by $$\textit{Stretched length} = (R+z)\theta$$

where z is the distance measured from the neutral axis 103. Substituting these results into the definition of strain gives $$\text{strain} = S = \frac{(R+z)\theta - R\theta}{R\theta} = \frac{z}{R}$$

The strain is zero along the neutral axis 103, and has the highest magnitude at the top and bottom of the layer, $z=\pm b/2$. The magnitude of strain at these locations is $$S_{max} = \frac{b}{2R}$$

this value is important in practical design because it sets a limit on the deformation of the material before it breaks or yields. It has been found that Kynar® breaks at an elongation of 25 to 40%, so the strain should be held to much lower levels to prevent mechanical degradation, cracking, etc. over the lifetime of the device. For example, a practical limit to the strain might be taken as 1%.

Unlike more conventional power supplies, however, the voltage is not set by external controls, but by the bending strain in the film. The practical limit for strain is controlled by both the film thickness and the radius of the roller. For a 1% strain, $$\frac{b}{2R} = 0.01$$

Thus a 0.1 mm bimorph film would reach its 1% strain level when bent around a roller with a radius of $$R = 5 \text{ mm}$$

If the roller had a larger radius, the field would be below its limit, while if the radius were smaller, the stretching might lead to degradation of the layer. If a larger roller had to be used, then the bilayer would have to be made thicker to generate the desired field, and at the same time care would be needed in the mechanical design, to ensure that the belt did not pass over sharper bends which would lead to excessive strain.

The formula below for strain is written in terms of R, the radius of curvature of the neutral layer. In practice, this distance is composed of contributions from the roller and from the thickness of the layer itself. The radius of the neutral layer is $$R = R_r + b/2$$

where b is the thickness of the belt and $R_r$ is the radius of the roller. The two radii are related by $$\frac{R_r}{R} = 1 - \frac{b}{2R}$$

For this example, the strain limit is ~1%, which means that b/2R will also be on the order of 1%. since this is a small difference, it will be neglected. It should be important only if larger strain were allowed. For example $$R \approx R_r$$

The surface potential generated across the Xeromorph (bimorph) is characterized by the following:

When a bimorph Xeromorph laminated sheet is bent, the positive strain in the outside layer generates a positive voltage and the negative strain in the inner layer also generates a positive voltage, due to the reversal of the polarization.

The surface potential arising in these circumstances is twice that which arises across one of the layers Using the expression for strain in bending $$\frac{V_o}{2} = \int_0^{b/2} hSdz$$

$$S = \frac{z}{R}$$

in the voltage integral gives the open circuit voltage of the bimorph as $$V_{ob} = \frac{hb^2}{4R}$$

These equations can be compared to the experimental results obtained in tests carried out on bimorphs. The film was fabricated by bonding two 4 mil Kynar® sheets back to back, giving a total thickness of 0.22 mm. The laminate sheet was then bent around circular forms of different diameters, and the surface potential measured with an electrostatic voltmeter. The measurements obtained in these tests are listed in Table 1.

TABLE 1

Experimental results for a bimorph

| R, in | R, mm | $V_0$ | strain, % |
|---|---|---|---|
| 0.15 | 3.81 | 1400 | 2.8 |
| 0.20 | 5.08 | 1000 | 2.2 |
| 0.275 | 6.99 | 750 | 1.6 |

Figure 10:
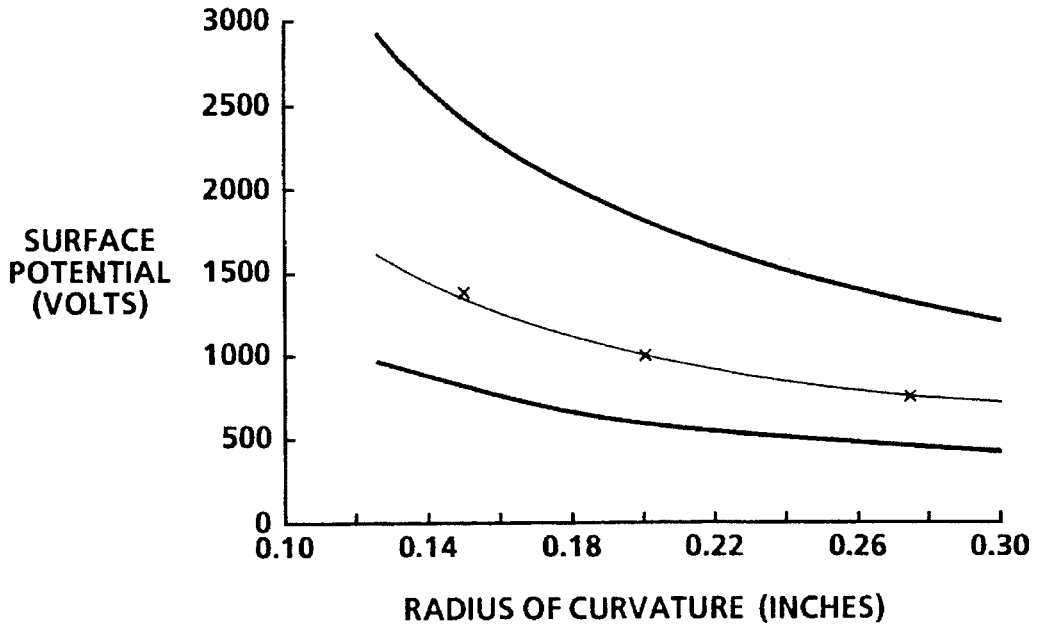
FIG. 10 illustrates experimental results for a bimorph Xeromorph which is utilized by the present invention.

Both the thickness and the curvature are known from the geometry of the experiment, so once the piezoelectric coefficient, h, is known, the open circuit voltage predicted by the model can be calculated. The proper value of h has been calculated from properties listed in the Pennwalt, "Kynar Piezo Film" , brochure and "Kynar Piezo Film" technical manual. The largest and smallest values which might be expected were given as $h_{min}$=261 V/μm $h_{max}$=770 V/μm the voltage predictions of the model were plotted for both of the limits, which are shown in FIG. 10, along with the measured values, as a function of the curvature.

The experimental measurements of surface potential are bracketed by the model predictions, indicating that the magnitude of the potential can be related to basic properties of the material. From the measured voltages, an apparent value of the piezoelectric coefficient, h, was determined by fitting the three data points to create the curve in the middle. This curve passes very close to each of the data points, which further indicates that the voltage has the predicted dependence on the radius of curvature. Since the results are in agreement, the apparent value of h, as taken from the fitted curve will be used in the following modeling. This fitted value is $h_{fit}$=431 V/μm While the surface potential is easily measured, and serves as an indication of the magnitude of the effect, it is not the most useful quantity for application design. In a transfer station, for example, a high electric field is needed in the air gap to drive toner across to the paper. Likewise in the development nip, it is the electric field which must be high to complete the process. In conventional dielectric webs, the surface potential and the field in the gap are directly related because the field is produced by a charge on the surface of the dielectric. This is not the case in a piezoelectric web, however, since the field is generated by a polarization in the bulk of the material, which is also varying with location. The E field in the air gap must be calculated from the basic electrostatic relations for the geometry involved.

Figure 11:
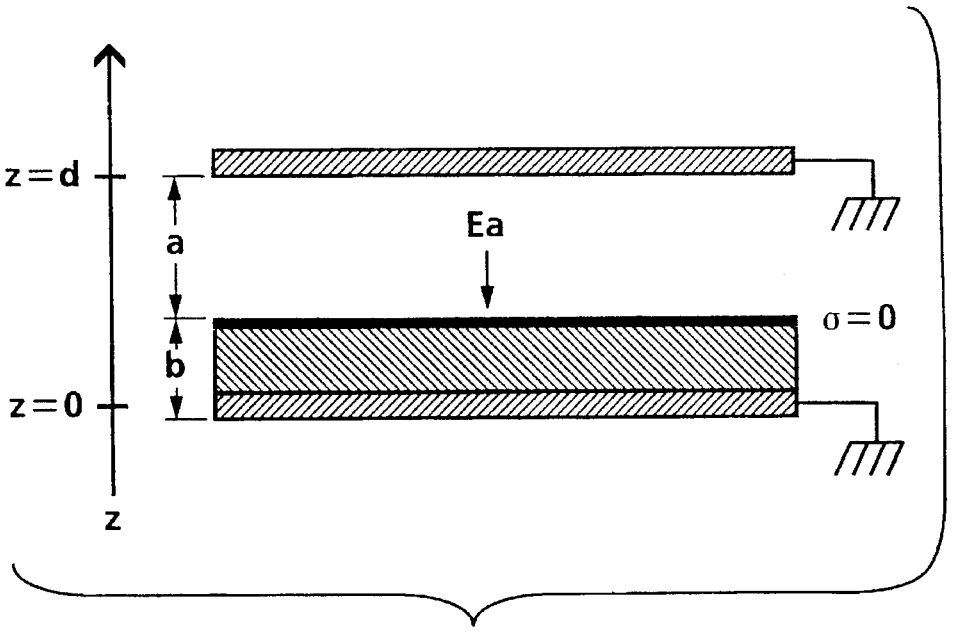
FIG. 11 illustrates the geometry of a piezoelectric layer which is grounded on one side.

A typical geometry involves a piezoelectric layer which is grounded on one side, and has an air gap of finite thickness on the other, as shown in FIG. 11.

The piezoelectric layer has a depth, b, and the air layer has a thickness, a. As before, both the surface charge and the bulk charge are assumed to be zero, so the D vectors are uniform in both layers, and equal to each other. In this case, however, the E field does not vanish in the air. The value of the D field in the gaps is given by $$D=\epsilon_0 E_a=\epsilon E_b+P$$

which can be solved for the field in the piezoelectric layer as $$E_b=\frac{D}{\epsilon}-\frac{P}{\epsilon}$$

Since there are grounded electrodes above the air layer and below the piezoelectric layer, the net voltage drop across both layers must vanish.

$$aE_a+\int_0^b E_b dz=0$$

Substitution of the expression for $E_b$ gives
or, using the definition of the surface potential, $$aE_a+\frac{bD}{\epsilon}-\int_0^b \frac{P}{\epsilon}\,dz=0$$

Recalling that $$aE_a+\frac{bD}{\epsilon}=V_o$$

$$D=\epsilon_0 E_a$$

gives the result for the electric field in the air gap above the bent piezoelectric layer as $$E_a=\frac{V_o}{a+b/\kappa}$$

The surface potential for the bimorph has been calculated before. It is $$V_o=V_{ob}=\frac{hb^2}{4R}$$

Substituting this into the equation for E field in the air gap gives $$E_a=\frac{hb}{4R}\;\frac{b}{(a+b/\kappa)}$$

From this expression, it is clear that the electric field will be largest when the air gap, a, is small compared to the dielectric thickness of piezoelectric layer. In this case, a <<b/$K_b$, the E field in the air becomes $$E_{a,lim}=\frac{h\kappa}{2}\;\frac{b}{2R}$$

Note that it does not increase indefinitely as the air gap becomes smaller, but reaches a finite value.

The second term in the expression for the electric field is the elastic strain, which is limited to a value below the breaking point of the piezoelectric layer. For Kynar®, the strain of 1% was assumed which is safely below the breaking strain of 25–40%. Denoting the maximum strain to tolerate in a given application by $S_{max}$. The largest electric field which can be generated in a small air gap is $$E_{a,max}=\frac{1}{2}\,h\kappa S_{max}$$

As in the previous examples, the following parameters might be assumed $S_{max}$=0.01 h=431×$10^6$ V/m

K=12

Under these circumstances, the E field in the air could become as large as $E_{a,max}$=51.7 V/μm which is slightly smaller than the breakdown of air in a very small gap (68 V/μm), and much larger than the breakdown field of a wide gap (3 V/μm). Thus, a small gap next to a bent piezoelectric film would experience electric fields almost as large as any in current power supplies employed in electrostatic machines, even with a 1% strain. This indicates that currently available materials can generate a field to replace most conventional high voltage supplies in subsystems like transfer and development.

The maximum output can be obtained with any bimorph of a given thickness if the roller radius is chosen appropriately. In many cases, however, the roller radius is not under our control. If it is too large, then the output will be reduced below its maximum value.

In a unimorph Xeromorph, as shown in FIG. 8, the total thickness of the belt is given by b. The thickness of the active piezoelectric layer on the outside of the bend is given by $b_a$. This layer is open to the air above it, and is grounded at the point where it is laminated to the substrate. The ground plane could also be placed under the substrate, but this would give a much lower output.

The open circuit voltage developed by this arrangement is given by the same formula as for the bimorph Xeromorph, but the integral is only evaluated over the active region, and not the entire belt, $$V_o = \int_{\text{active region}} \frac{P(z)}{\epsilon}\, dz$$

The active region only extends over the thickness of the active piezoelectric layer on the top of the laminate, so the integral becomes $$V_o = \int_{b/2-b_a}^{b/2} \frac{hz}{R}\, dz = \frac{hb_a(b-b_a)}{2R}$$

using the same strain as in the previous case. In the special case where the active layer extends all the way across the film, $b_a$=b, this gives an open circuit voltage of $V_0$=0, as expected. If the active layer extends half way across, $b_z$=b/2, the voltage reduces to $$V_o = \frac{hb^2}{8R} = \frac{1}{2} V_{ob}$$

which is half of the full Xeromorph (bimorph) voltage obtained earlier.

In order to compare the situation with a single active layer or a passive substrate to the Xeromorph (bimorph), it is useful to normalize the open circuit voltage to the reference value obtained with the Xeromorph (bimorph). The voltage can be rewritten as $$V_o = \frac{hb^2}{2R}\ \frac{b_a}{b}\left(1-\frac{b_a}{b}\right) = 2\frac{b_a}{b}\left(1-\frac{b_a}{b}\right) V_{ob}$$

The maximum value of this voltage is ½ $V_0$, and occurs when the active layer is one-half the thickness of the whole belt. Thus, for the same belt thickness, this arrangement always gives a lower output voltage than the bimorph. An advantageous feature of the Xeromorph (unimorph) comes mainly in allowing high electric fields over large diameter rollers, as described below.

Measurements have been carried out of the surface potential for unimorph structures using various thicknesses for the Kynar® film and for the substrate, which was a plastic shimstock. These two layers were laminated, and then bent over a piece of PVC tubing with a radius of 0.9375 inches (23.8 mm). A summary of the test results is shown in Table 2.

TABLE 2

| $R_r$, mm | $b_a$, mm | $b_p$, mm | b, mm | R = $R_r$ + b/2 | $V_o$, mod | $V_o$, exp | $V_o$, exp/ $V_o$, mod | strain, b/2R, % |
|---|---|---|---|---|---|---|---|---|
| 23.813 | 0.028 | 0.254 | 0.282 | 23.954 | 64 | 95 | 1.48 | 0.59 |
| 23.813 | 0.028 | 0.508 | 0.536 | 24.081 | 127 | 115 | 0.90 | 1.13 |
| 23.813 | 0.028 | 0.762 | 0.790 | 24.208 | 190 | 120 | 0.63 | 1.66 |
| 23.813 | 0.052 | 0.254 | 0.306 | 23.966 | 119 | 230 | 1.94 | 0.64 |
| 23.813 | 0.052 | 0.508 | 0.560 | 24.093 | 236 | 300 | 1.27 | 1.18 |
| 23.813 | 0.110 | 0.254 | 0.364 | 23.995 | 251 | 270 | 1.08 | 0.76 |
| 23.813 | 0.110 | 0.508 | 0.618 | 24.122 | 499 | 330 | 0.66 | 1.30 |

Figure 12:
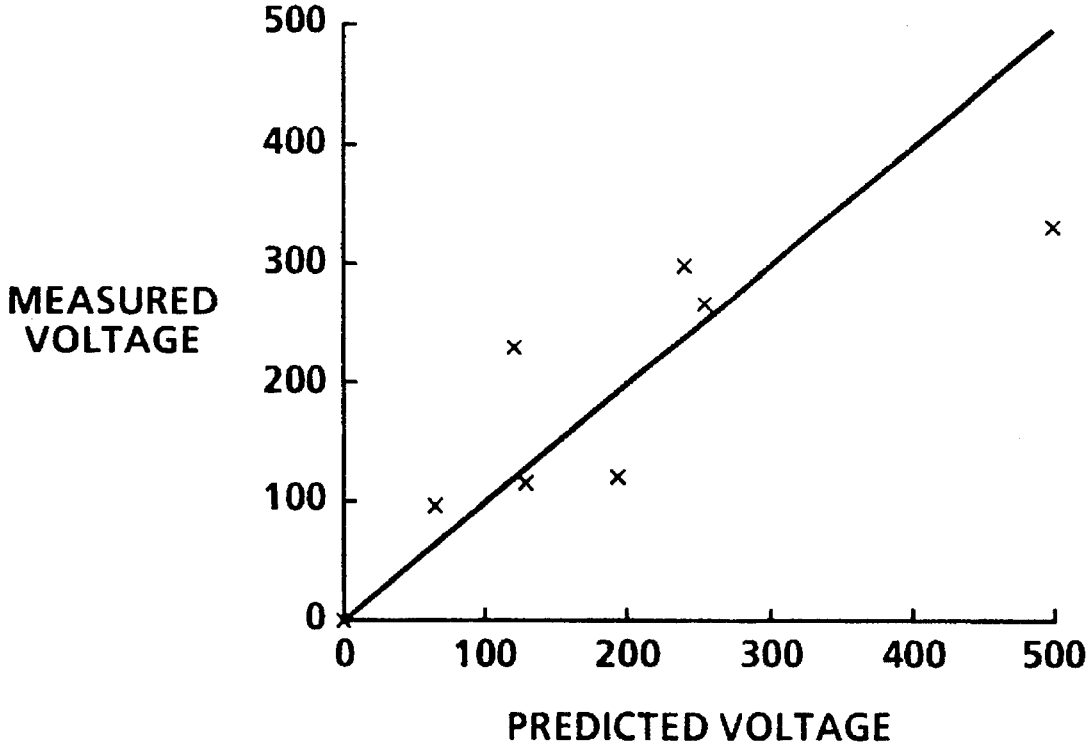
FIG. 12 illustrates experimental results for a unimorph Xeromorph which is utilized by the present invention.

The voltage predicted by the model was calculated using the fitted value of h (432 V/μm) obtained in the measurements on bimorphs. The actual radius of the neutral layer, rather than the radius of the tubing, was used to compute the radius of curvature, R. A comparison of the measured and predicted voltages is shown in FIG. 12.

If perfect agreement were obtained, the experimental points would all lie on the diagonal line. The actual measurements bracket the line, indicating that the model is predicting the correct voltage, on the average. Thus both the unimorph, as well as the bimorph, are believed to be adequately described by the model.

The electric field in the gap is calculated in the same way as for the bimorph. Since the ground plane is at the bottom of the active layer, the passive substrate has no effect on the field in the air gap, which is given by $$E_a = \frac{V_o}{(a + b_a/\kappa)}$$

Substituting the value for the open circuit voltage of the active layer gives $$E_a = h\frac{b}{2R}\ b\frac{(b_a/b) + (1 - b_a/b)}{(a + b_a/\kappa)}$$

Analogous to the Xeromorph (bimorph) case, the largest field in the air gap occurs when the air gap is much less than the dielectric thickness of the active layer. This optimum air gap field is $$E_{a,\,lim} = h\kappa\frac{b}{2R}\left(1-\frac{b_a}{b}\right)$$

This field is limited by the allowable strain in the active layer to a value of $$E_{a,\,max} = h\kappa S_{max}\left(1 - \frac{b_a}{b}\right)$$

As an example of the effectiveness of the Xeromorph (unimorph) configuration, consider a roller with a radius of 100 mm (roller diameter of approximately 8 inches). If the maximum strain at the surface is taken to be 1%, as before, then the thickness of the belt is obtained from $$\frac{b}{2(100)} = 0.01$$

as b=2 mm. This is much thicker than piezoelectric film, which is usually supplied in dimensions of a few mils. If a thin piezoelectric film is mounted on top of a passive substrate higher performance can be obtained as compared to a bimorph. For example, consider a 4 mil piezoelectric film ($b_a$=0.1 mm) mounted on a flexible substrate so that the total thickness is 2 mm, as required for maximum allowed strain. In this example, $$\frac{b_a}{b} = \frac{0.1}{2} = 0.05$$

and the maximum air gap field is given by $$E_{max}=0.95\ hK_b\ S_{max}$$

Under the same conditions, the bimorph geometry gives a maximum field which has a coefficient of ½, so the unimorph actually gives almost twice the output of the bimorph, while turning around a larger radius. Using the same values of piezoelectric and dielectric constants and maximum strain as before (Smax→0.01, h=431×10$^6$ V/m, K =12) is $$E_{a,max}=98.3\ v/\mu m$$

which is much higher than the breakdown field of air, even in very small gaps.

In recapulation, there has been provided an apparatus and method for depositing a surface charge on a dielectric medium moving at a predetermine velocity in a direction of movement, including an endless web having an exterior layer comprising piezoelectric material, positioned adjacent to the dielectric medium, for generating and laying down a surface charge on the dielectric medium in response to the endless web being deformed. The endless web is entrained about two rollers to deform the exterior layer. There has also been provided a model which predicts the voltages and electric fields produced by bending of the Xeromorph structures. The voltage depends on the thickness the structure, the radius of the bend, and the piezoelectric coefficient h, which is characteristic of the material.

It is, therefore, evident that there has been provided, in accordance, with the present invention, a charging member that fully satisfies the aims and advantages of the invention as hereinabove set forth. While the invention has been described in conjunction with preferred embodiments thereof, it is evident that many alternatives, modifications, and variations may be apparent to those skilled in the art. Accordingly, the present application for patent is intended to embrace all such alternatives, modifications, and variations as are within the broad scope and spirit of the appended claims.

I claim:

1. An apparatus for depositing a charge on a surface, comprising.

an endless web including a piezoelectric exterior layer, said endless web having a first portion positioned spaced from said surface and a second portion positioned adjacent to the surface for depositing the charge on the surface in response to said piezoelectric exterior layer being deformed; and a member, being interior of said endless web, for deforming said piezoelectric exterior layer.

2. The apparatus of claim 1, wherein said member comprises a plurality of rollers, said endless web being entrained about said plurality of rollers to deform said piezoelectric exterior layer thereof.

3. The apparatus of claim 1, wherein said piezoelectric exterior layer comprises a layer of piezoelectric polymer film.

4. The apparatus of claim 1, wherein said piezoelectric exterior layer comprises:

a first layer of piezoelectric polymer film having a first polarization direction; and a second layer of piezoelectric polymer film having a second polarization direction opposed to the first polarization direction.

5. The apparatus of claim 1, further comprising means for moving the surface at a first predetermined velocity in a direction of movement, and means for moving said web at a second predetermined velocity in the direction of movement relative to the surface.

6. The apparatus of claim 5, wherein said first predetermined velocity and said second predetermined velocity have a ratio greater than 3.

7. An apparatus for depositing a charge on a surface, comprising;

an endless web including a piezoelectric exterior layer, positioned adjacent to the surface, for depositing the charge on the surface in response to said piezoelectric exterior layer being deformed;

a plurality of rollers, said endless web being entrained about said plurality of rollers to deform said piezoelectric exterior layer thereof; and wherein one of said plurality of rollers has a substantially different radii than another of said plurality of rollers to deform said piezoelectric exterior layer for depositing a tailored electric field on the surface.

8. A method of depositing a charge on a surface, comprising the steps of:

providing an endless web including piezoelectric exterior layer;

positioning a first portion of the endless web spaced from the surface and a second portion of the endless web adjacent to the surface; and deforming the exterior piezoelectric layer of the endless web to generate an electric field that deposit the charge on the surface.

9. The method of claim 8, wherein said positioning step comprises the step of entraining the endless web about a plurality of rollers.

10. The method of claim 9, wherein said deforming step comprises the step of deforming the endless web about one of the plurality of rollers.

11. The method of claim 10, further comprising the steps of:

moving the surface at a first predetermined velocity in a direction of movement; and rotating one of the plurality of rollers so that the endless web moves at a second predetermined velocity in the direction of movement.

12. An apparatus for depositing a charge on a surface of an imaging member, comprising:

a discrete charging means having an endless web including a piezoelectric exterior layer, said endless web having a first portion positioned spaced from said surface of the imaging member and a second portion positioned to engage the surface of the imaging member to deposit the charge on the surface of the imaging member in response to said piezoelectric exterior layer being deformed; and wherein said discrete charging means includes a deforming member, being interior of said endless web, for deforming said piezoelectric exterior layer.

13. The apparatus of claim 12, wherein said deforming member comprises a plurality of rollers, said endless web being entrained about said plurality of rollers to deform said piezoelectric exterior layer thereof.

* * * * *